US006351520B1

(12) United States Patent
Inazaru

(10) Patent No.: US 6,351,520 B1
(45) Date of Patent: Feb. 26, 2002

(54) X-RAY TUBE

(75) Inventor: Tutomu Inazaru, Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 0 days.

(21) Appl. No.: 09/555,451

(22) PCT Filed: Dec. 4, 1998

(86) PCT No.: PCT/JP98/05466

§ 371 Date: May 31, 2000

§ 102(e) Date: May 31, 2000

(87) PCT Pub. No.: WO99/28942

PCT Pub. Date: Jun. 10, 1999

(30) Foreign Application Priority Data

Dec. 4, 1997 (JP) ..... 9-334370

(51) Int. Cl.[7] ..... H01J 35/14
(52) U.S. Cl. ..... 378/138; 378/143
(58) Field of Search ..... 378/119, 138, 378/143

(56) References Cited

U.S. PATENT DOCUMENTS 4,075,526 A * 2/1978 Grubis ..... 378/143
4,969,173 A * 11/1990 Valkonet ..... 378/143
6,044,130 A * 3/2000 Inazura et al. ..... 378/143

FOREIGN PATENT DOCUMENTS

| | | |
|---|---|---|
| JP | A-4-133245 | 5/1992 |
| JP | A-9-180630 | 7/1997 |
| JP | A-9-180660 | 7/1997 |

* cited by examiner

*Primary Examiner*—Drew Dunn
(74) *Attorney, Agent, or Firm*—Oliff & Berridge, PLC

(57) ABSTRACT

An x-ray tube providing excellent assembleability and handleability. An electrically conductive metallized layer 11 is provided on the surface of a stem 3. Therefore, when the x-ray tube 1 is being produced, thermally fusing nature of brazing material A provided between the stem 3 and the lower edge portion 8*a* of the focussing electrode 8 can be improved by the metallized layer 11. Further, the metallized layer 11 extends from the lower edge portion 8*a* of the focussing electrode 8 to the low voltage cathode pin 5*a*. Therefore, electric continuity between the focussing electrode 8 and the low voltage cathode pin 5*a* is achieved on the surface 3*a* of the stem 3. There is no need for separate wiring operations after the x-ray tube 1 is assembled. Connection between the focussing electrode 8 and the cathode pin 5*a* can be completed simultaneously with completion of the brazing connection.

5 Claims, 6 Drawing Sheets

X-RAY TUBE

TECHNICAL FIELD

The present invention relates to an x-ray tube, and more particularly, to an x-ray tube wherein a ceramic bulb, a ceramic stem, and an output window are brazed together using a brazing agent.

BACKGROUND ART

Japanese Patent Application Publication (Kokai) Nos. HEI-9-180630 and HEI-9-180660 disclose technologies in this field. An x-ray tube 100 disclosed in these publications has as shown in FIG. 10 a sealed vessel 104 configured from a ceramic bulb 101, a ceramic stem 102 fixed to one open end of the ceramic bulb 101 by a brazing agent P, and an output window 103 fixed to another open end of the ceramic bulb 101 by a brazing agent R. Further, a low voltage cathode pin 105 and a high voltage cathode pin 106 are fixed onto the ceramic stem 102. An electron discharge filament 107 is disposed in the sealed vessel 104 so as to span between the cathode pins 105 and 106. Also, a cylindrical focusing electrode 108 is disposed in the sealed vessel 104 so as to surround the filament 107. A lower end portion 108*a* of the cylindrical focussing electrode 108 is sandwiched between the ceramic bulb 101 and the ceramic stem 102 with interposing the brazing agent P therebetween so that the ceramic stem 102 is fixed with respect to the ceramic bulb 101. In this way, each component is connected together with interposing the brazing agent P, R therebetween so that assembly of the x-ray tube 100 is improved. Also, the cylindrical focussing electrode 108 and the low voltage cathode pin 105 are connected together by a wire 109 because these need to have the same bias. This wire connection is performed by a subsequent soldering.

However, the following problem exist because the conventional x-ray tube is configured in the above-described manner. That is, because the electric connection between the cylindrical focussing electrode 108 and the low voltage cathode pin 105 is performed through the wire 109, the wiring operation for the wire 109 must be performed separately after the x-ray tube is assembled. Moreover, the wire 109 must be handled with a great care because the wire 109 is exposed out from the x-ray tube.

It is an object of the present invention to overcome the above-described problems and to provide an X-ray tube with excellent assembleability and handling.

DISCLOSURE OF THE INVENTION

To attain the above described object, the present invention provides an x-ray tube including a sealed vessel comprising a bulb having one open end and another open end, a stem fixed to the one open end of the bulb, and an output window fixed to the another open end of the bulb, a low voltage cathode pin and high voltage cathode pin extending through the stem, a filament for emitting electrons spanning between the low voltage cathode and the high voltage cathode in the sealed vessel, a focussing electrode disposed in the sealed vessel and surrounding the filament for converging electrons emitted from the filament and directing the electrons toward the output window so as to discharge an x-ray outwardly out of the output window, characterized by the focussing electrode having a lower end portion sandwiched between the bulb and the stem, and the stem having a surface formed with a metallized layer made from an electrically conductive material, the metallized layer extending at least from the lower end portion of the focussing electrode to the low voltage cathode pin, a brazing material being interposed between the metallized layer and the lower end portion of the focussing electrode for electrically connecting the focussing electrode to the low voltage cathode pin.

The X-ray tube of the present invention is provided with the electrically conductive metallized layer on the surface of the stem. Therefore, during production of the x-ray tube, thermally fusing nature of the brazing agent provided between the stem and the lower end portion of the focussing electrode is improved by the metallized layer. Moreover, the metallized layer extends from the lower end portion of the focussing electrode to the low voltage cathode pin. Therefore, electrical continuity of the focussing electrode and the low voltage cathode is realized on the surface of the stem. Thus, there is no need to perform any separate wiring operations after x-ray tube is assembled. The connection between the focussing electrode and the cathode pin is completed simultaneously with completion of x-ray brazing. Accordingly, assembleability and the handleablity of the X-ray tube can be improved.

Here, the electrically conductive metallized layer is preferably formed on an entire front surface of the stem except an area surrounding the high voltage cathode pin, the front surface of the stem being in confrontation with the output window. Further, in a preferred fashion, a separation groove surrounding the high voltage cathode pin is formed. The electrically conductive metallized layer is removed at a position of the separation groove.

When this type of configuration is used, the metallized layer can be formed at one time over the entire surface of the stem. Therefore, the formation of the metallized layer that is to bring the lower portion of the focussing electrode and the low voltage cathode pin into the electric continuity can be efficiently and simply performed. Also, by forming the separation groove around the high voltage cathode pin, electrical insulation between the high voltage cathode pin and the low voltage cathode pin can be accomplished in the stem surface. Moreover, because the high voltage cathode pin is disposed at an inner side of the separation groove, even if the molten brazing agent flows on the metallized layer, any excessive brazing agent can flow into the separation groove. Thus, assembleability and high yieldability of the x-ray tube using brazing agent can be assured.

In another embodiment, the electrically conductive metallized layer is formed on the stem surface in confrontation with the output window, and the metallized layer includes a first metallized layer having a ring shape matching a contour of the lower end portion of the focussing electrode, and a second metallized layer having a linear shape and radially inwardly extending from an inner periphery of the first metallized layer to the low voltage cathode pin.

In still another embodiment, the electrically conductive metallized layer has a U-shaped configuration having a front surface portion on a front stem surface which is in confrontation with the output window, and a rear surface portion continuous with the front surface portion and at a position on a rear stem surface opposite to the front stem surface. The front surface portion of the metallized layer is formed at a position in contact with at least a part of the lower end portion of the focussing electrode, and the rear surface portion of the metallized layer is formed to reach the low voltage cathode pin.

BEST MODE FOR CARRYING OUT THE INVENTION

An x-ray tube according to preferred embodiments of the present invention will be described in detail with reference to the drawings.

Figure 1:
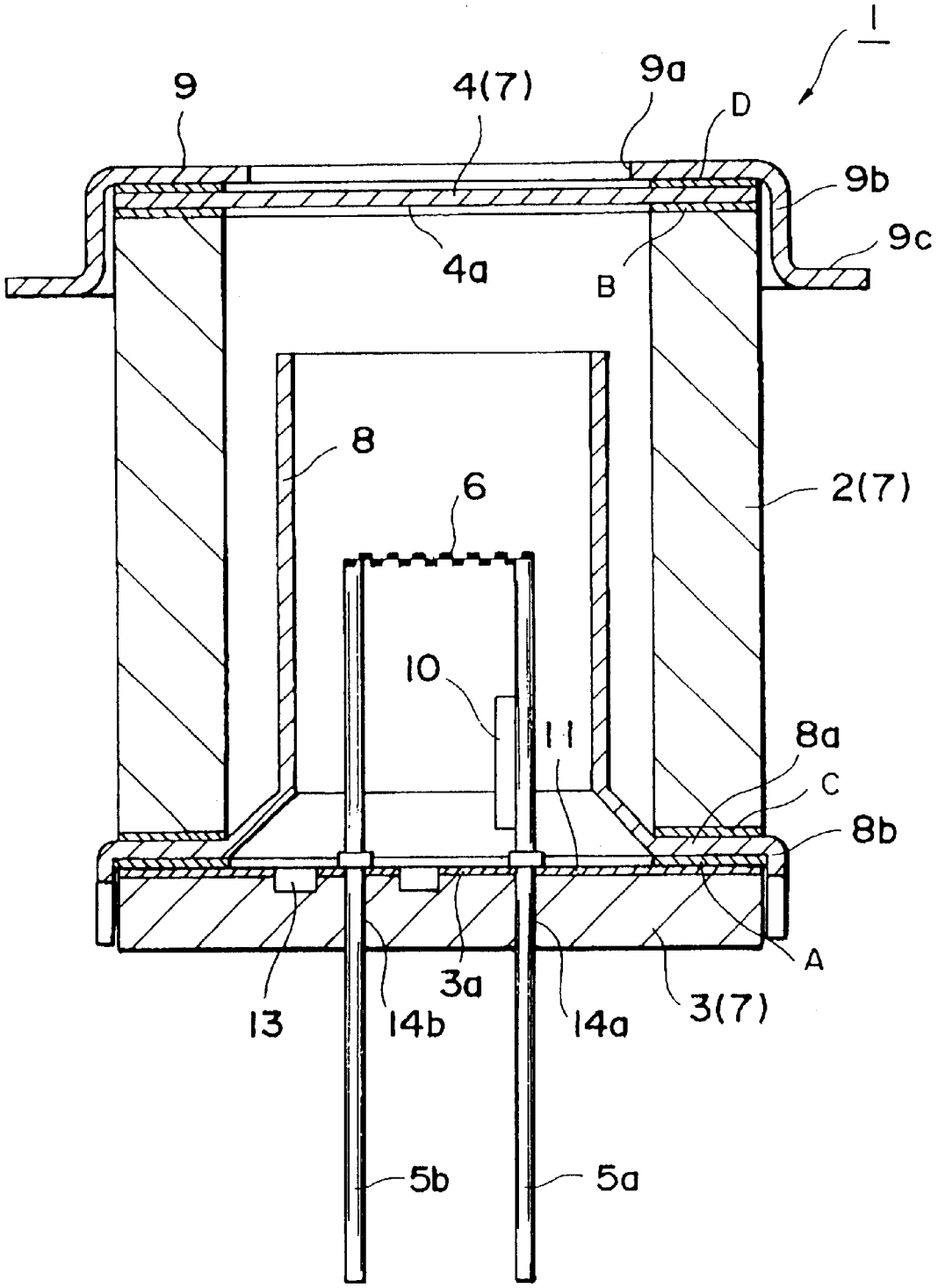
FIG. 1 is a cross-sectional view showing an x-ray tube according to one embodiment of the present invention.

The x-ray tube shown in FIG. 1 has an electrically insulative cylindrical bulb 2 formed from a ceramics. An electrically insulative disc shaped stem 3 formed from ceramics is fixed to one open end of the bulb 2. A disc shaped output window 4 is fixed to another open end of the bulb 2. A target metal 4*a* formed from W, Ti and the like is deposited on an inner surface of the output window 4.

A low voltage cathode pin 5*a* and a high voltage cathode pin 5*b* in parallel with each other penetrate through and fixed to the center of the stem 3. In the bulb 2, an electron discharge cathode filament 6 is fixed so as to spin from a tip of the low voltage cathode pin 5*a* to a tip of the high voltage cathode pin 5*b*. A sealed vessel 7 is configured from the bulb 2, the stem 3, and the output window 4. Inside of the vessel 7 is maintained in a high vacuumed condition (for example, $1\times10^{-6}$ Torr). Therefore, the cathode filament 6 is disposed in a high vacuum. Incidentally, in FIG. 1, 3*a* designates an inner front surface of the stem 3, 11 designates a metallized layer, 13 designates a separation grooves, and 14*a*, 14*b* designate through holes for the cathode pins 5*a*, 5*b*. These will be described in detail with reference to FIGS. 2 and 3.

Further the x-ray tube 1 has a cylindrical focussing electrode 8 formed from Kovar alloy in the sealed vessel 7. A donut shaped flange portion 8*a* radially outwardly protrudes from the lower end portion of the focussing electrode 8. By sandwiching this flange portion 8*a* between the bulb 2 and the stem 3, the focussing electrode 8 can be reliably fixed in the bulb 2. Further, an annular skirt portion 8*b* is formed in the outer peripheral edge portion of the flange portion 8*a*. The inner diameter of the skirt portion 8*a* is formed slightly greater than the outer diameter of the disc shaped stem 3 for surrounding the stem 3. Accordingly, when assembling the x-ray tube 1, the positional relationship between the stem 3 and the focussing electrode 8 can be simply and reliably determined by merely positioning the stem 3 within the skirt portion 8*b*.

Further, the x-ray tube 1 has a conductive metal cap 9 disposed on the output window 4. The cap 9 has a center portion formed with a circular opening 9*a* through which the output window 4 appears. The cap 9 has an annular sleeve portion 9*b* surrounding the end portion of the bulb 2 and the output window 4. Further, a flange 9*c* is provided at a free end of the annular sleeve 9*b* by bending the free end portion outwardly. In this way, by providing the sleeve portion 9*b* on the cap 9, then during assembly of the x-ray tube 1, the positional relationship among the output window 4, the cap 9, and the bulb 2 can be easily and reliably determined.

Each component of the x-ray tube 1 with this configuration is coupled and fixed together by brazing agent whose main component is silver (Ag) and moreover melts at about 800 degrees centigrade. In concrete terms, connection portion of the stem 3 and the flange portion 8*a* of the focussing electrode 8 is coupled and fixed together by brazing a ring shaped first brazing agent A. The connection portion of the upper end of the bulb 2 and the output window 4 are coupled and fixed together by brazing a ring shaped second brazing agent B. The connection portion of the one end of the bulb 2 and the flange portion 8*a* of the focussing electrode 8 is coupled and fixed together by brazing a ring shaped third brazing agent C. The connection portion of the output window 4 and the cap 9 are coupled and fixed together by brazing a ring shaped fourth brazing agent D.

Incidentally, a getter 10 that is activated at brazing temperature (about 800 degrees centigrade) is provided in the vessel 7. The getter 10 is fixed onto the low voltage cathode pin 5*a*. Accordingly, any residual gas in the vessel 7 after assembly by brazing operation can be absorbed by the getter 10. By further increasing the vacuum within the vessel 7, the x-ray tube 1 with higher quality can be obtained.

In the x-ray tube with this configuration, x-ray is discharged to the outside from the output window 4 by electron discharged from the cathode filament 6 falling incident on the output window 4. It can of course be used broadly for medical and industrial purposes and also can be expected to be used in air cleaning devices.

Figure 2:
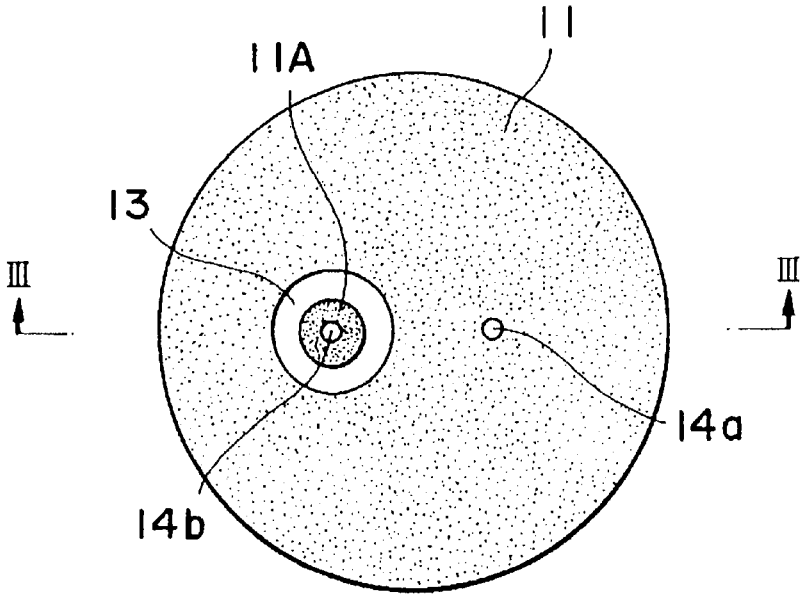
FIG. 2 is a plan view showing a stem applied to the x-ray tube of FIG. 1.
Figure 3:
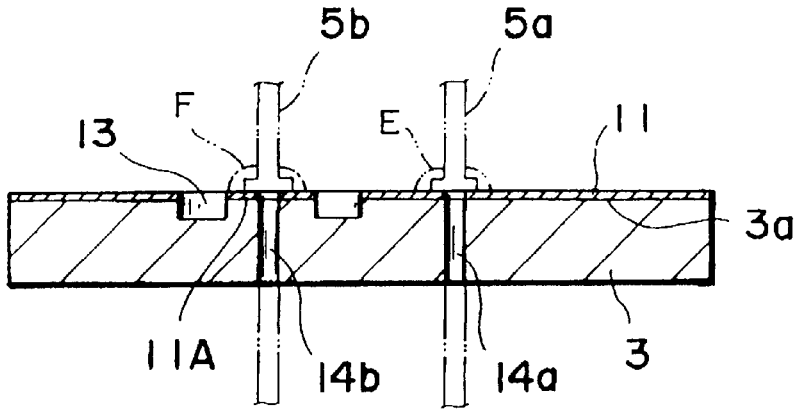
FIG. 3 is a cross-sectional view taken along a line III—III of FIG. 2.

Because there is a need for the focussing electrode 8 and the low voltage cathode pin 5*a* to have the same bias, as shown in FIGS. 2 and 3, a metallized layer 11 is formed on the inner front surface 3*a* of the stem 3. The metallized layer 11 is made from an electrically conductive metal material including as a main component Mn, Cu, formed across the approximate entire surface of the inner front surface 3*a* by pattern printing. A pin insertion hole 14*a* for inserting the low voltage cathode pin 5*a* is formed in the stem 3 within the region where the metallized layer 11 exists. Accordingly, when the cathode pin 5*a* is inserted into the pin insertion hole 14*a*, and the low voltage cathode pin 5*a* is fixed onto the stem 3 by brazing with the brazing material E on the metallized layer 11, then the low voltage cathode pin 5*a* becomes electrically connected with the metallized layer 11.

Because the metallized layer 11 is formed to the peripheral edge of the inner front surface 3*a* of the stem 3, the metallized layer extends until the position overlapping with the flange portion 8*a* of the focussing electrode 8. As a result, the low voltage cathode pin 5*a* and the focussing electrode 8 can be put into electrical continuity through the metallized layer 11 and the brazing material A (see FIG. 1).

Further, a pin insertion hole 14*b* for inserting the high voltage cathode pin 5*b* is formed in the stem 3. A ring shaped separation groove 13 that has an indented form in cross section is formed around the pin insertion hole 14*b*. The pin insertion hole 14*b* can be insulated from the above-described metallized layer 11 by the separation groove 13. A supplemental metallized layer 11A for improving the brazability of the high voltage cathode pin 5*b* and the stem 3 is formed interior to the separation groove 13. The high voltage cathode pin 5*b* is fixed to the stem 3 by the brazing agent F on top of the supplemental metallized layer 11A.

In this way, by forming the separation groove 13 in the stem 3, the metallized layer 11 can be print formed across the entire surface of the stem 3 at once. Therefore, the metallized layer 11 is extremely easy to form. This contributes to an improvement in productivity. When the metallized layer 11 is formed at once, the supplemental metallized layer 11A is also formed in the interior of the separation groove 13. However, this is electrically insulated because of the separation groove 13. Further, when the x-ray tube 1 is assembled in a vacuum brazing oven, even if melted brazing agent A, E, F flows along the metallized layer 11, the excessive brazing agent can flow into the separation groove 13. Thus, the high voltage cathode pin 5*b* will not be brought into electrical continuity with the low voltage cathode pin 5*a* or the focussing electrode 8. Accordingly, assembleability and yieldability of the x-ray tube can be greatly enhanced when assembling the x-ray tube 1 using brazing agent.

Next, a method of producing the x-ray tube 1 will be briefly described.

Figure 4:
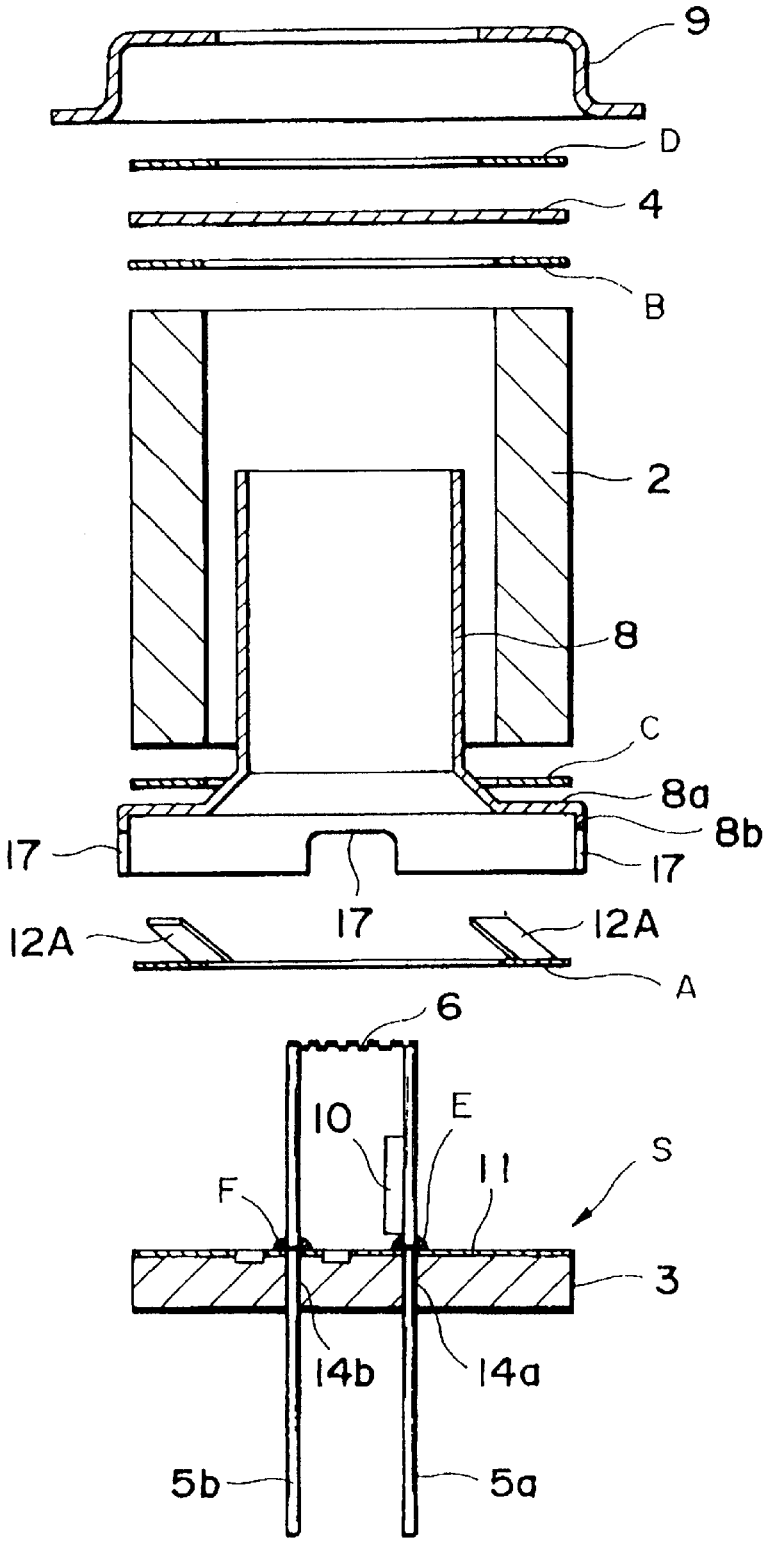
FIG. 4 is a fragmentary cross-sectional view showing arrangement relation of components before the x-ray tube is assembled.

As shown in FIG. 4, first a stem assembly body S is prepared. The assembly has the cathode pins 5*a*, 5*b*, which have fixed there to predetermined positions thereof the cathode filament 6 and the getter 10, are inserted into the pin insertion holes 14*a*, 14*b* of the stem 3 formed with the metallized layer 11. The low voltage cathode pin 5*a* is fixed to the stem 3 by the brazing agent E. The high voltage cathode pin 5*b* is fixed to the stem 3 by the brazing agent F. Afterward, the third brazing agent C, the focussing electrode 8, the first brazing agent A, and the stem assembly body S are stacked in this order at the one end of the bulb 2. It should be noted that four upright pawls 12A are provided on the first brazing agent A. Further, the second brazing material B, the output window 4, the fourth brazing agent D, and the cap 9 are stacked in this order with respect to the other end of the bulb 2. This stacking condition is set in a desired jig (not shown). While this condition is maintained, the x-ray tube 1 in the temporally assembled condition is transported into a vacuum brazing oven not shown in the drawings and with the cap 9 facing downward.

At this time, a gap for discharging gas is formed between the stem 3 and the flange portion 8*a* of the focussing electrode 8 by the four upright pawls 12A provided on the first brazing agent A. After maintaining this temporally assembled condition inside the vacuum brazing oven (hereinafter simply referred to as an oven) then operations to bring the inside of the oven to vacuum are started. The air within the bulb 2 continues to be discharged through the gap formed by the upright pawls 12A in association with this vacuum operation. At the timing of when the inside of the oven reaches not less than $1\times10^{-5}$ Torr, then heating of the oven is started. Temperature is increased until the inside of the oven reaches around 800° C. At this time, the first through fourth brazing agent A to D melt and simultaneously each of the upright pawls 12A melts so that maintaining the inside of the vessel 7 in a high vacuum condition, while brazing connection of all components can be achieved at once. Further, residual gas in the vessel 7 is absorbed by the getter 10, thereby increasing the vacuum in the vessel 7 so that even a higher quality x-ray tube 1 can be obtained in the oven.

Afterward, when the oven is gradually cooled off and leaked, an x-ray tube 1 with both sealing and air discharge operations completed can be obtained. By using this production method, the object taken out of the oven already has the shape of the final product so the method is available for mass production. Also, the x-ray tube conveyed from the oven does not need any separate wiring operations. At the point in time that the x-ray tube 1 is conveyed from the oven, the wiring between the focussing electrode 8 and the low voltage cathode pin 5*a* can be completed.

Figure 5:
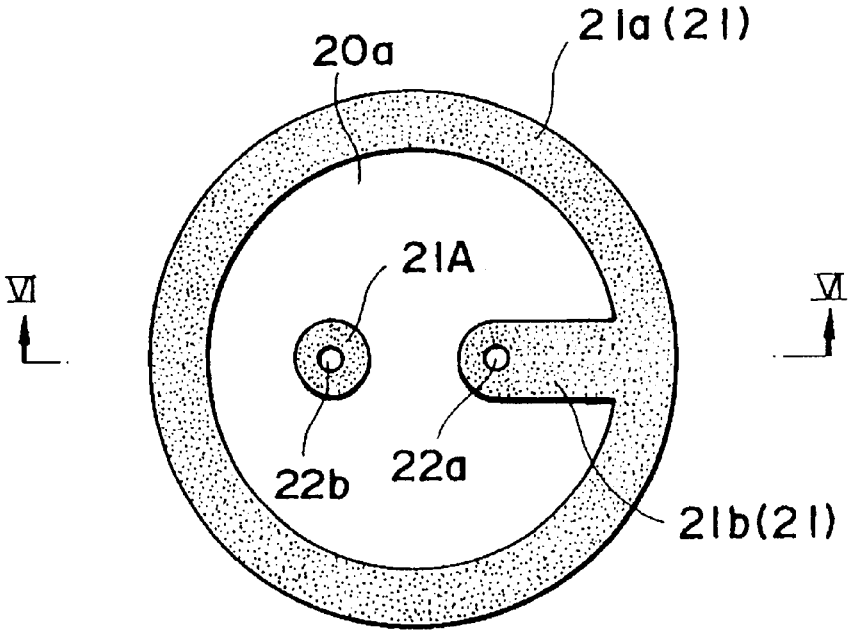
FIG. 5 is a plan view showing a stem according to a second embodiment.
Figure 6:
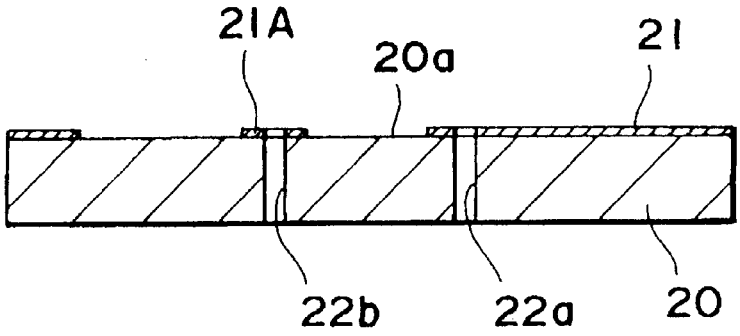
FIG. 6 is a cross-sectional view taken along a line VI—VI of FIG. 5.

A second embodiment relating to the stem of the present invention will be described based on FIGS. 5 and 6. A metallized layer 21 is provided on the inner front surface 21*a* of the stem 20. The metallized layer 21 extends from a position corresponding to the flange portion 8*a* (FIG. 1) of the focussing electrode 8 to an insertion hole 22*a* which is for inserting the low voltage cathode pin 5*a*. That is, the metallized layer 21 is made from a ring shaped first metallized layer 21*a* and a substantially linear second metallized layer 21*b*. the first metallized layer 21*a* approximately matches the shape of the flange portion 8*a* of the focussing electrode 8. The second metallized layer 21*b* extends inward from a portion of the first metallized layer 21*a* until the insertion hole 22*a*. Accordingly, when the low voltage cathode pin 5*a* (FIG. 1) is inserted into the pin insertion hole 22*a* and the low voltage cathode pin 5*a* is fixed to the stem 20 by brazing agent, then the low voltage cathode pin 5*a* and the focussing electrode 8 can be brought into electrical continuity by the first and second metallized layers 21*a*, 21*b*. In this case, a circular supplemental metallized layer 21A is formed around a pin insertion hole 22*b* which is for inserting the high voltage cathode pin 5*b*. The supplemental metallized layer 21A is formed by using pattern printing so as not to electrically continuous with the metallized layer 21.

Figure 7:
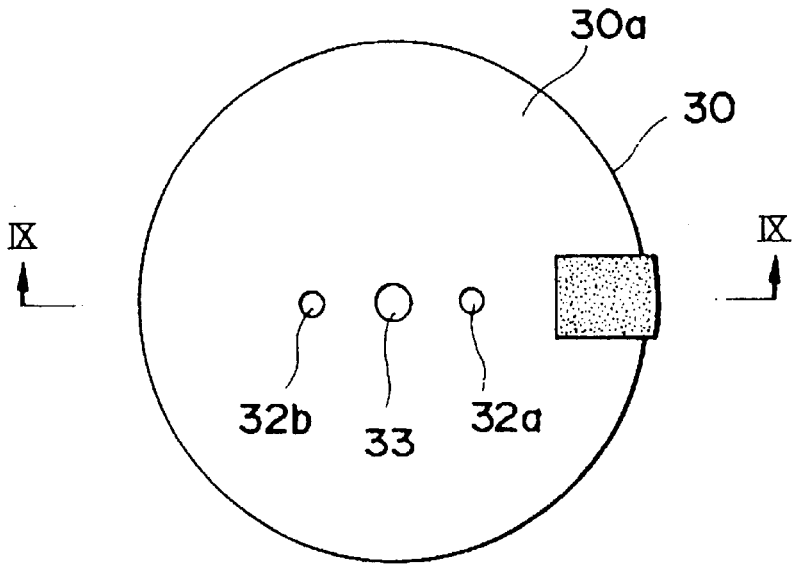
FIG. 7 is a plan view showing a stem according to a third embodiment.
Figure 8:
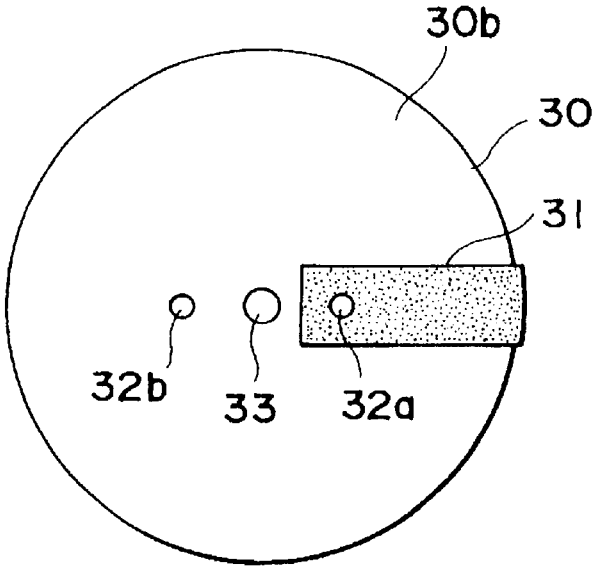
FIG. 8 is a bottom view of the stem of FIG. 7.
Figure 9:
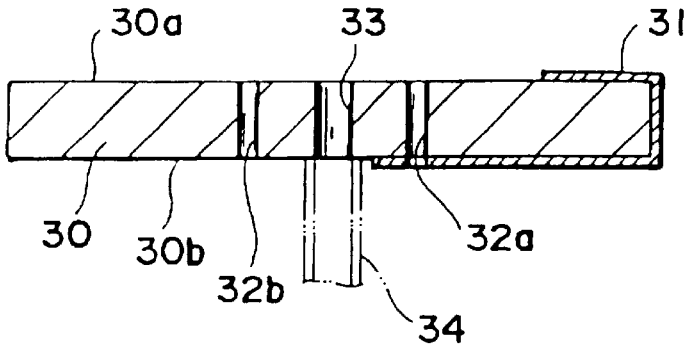
FIG. 9 is a cross-sectional view taken along a line IX—IX of FIG. 7.
Figure 10:
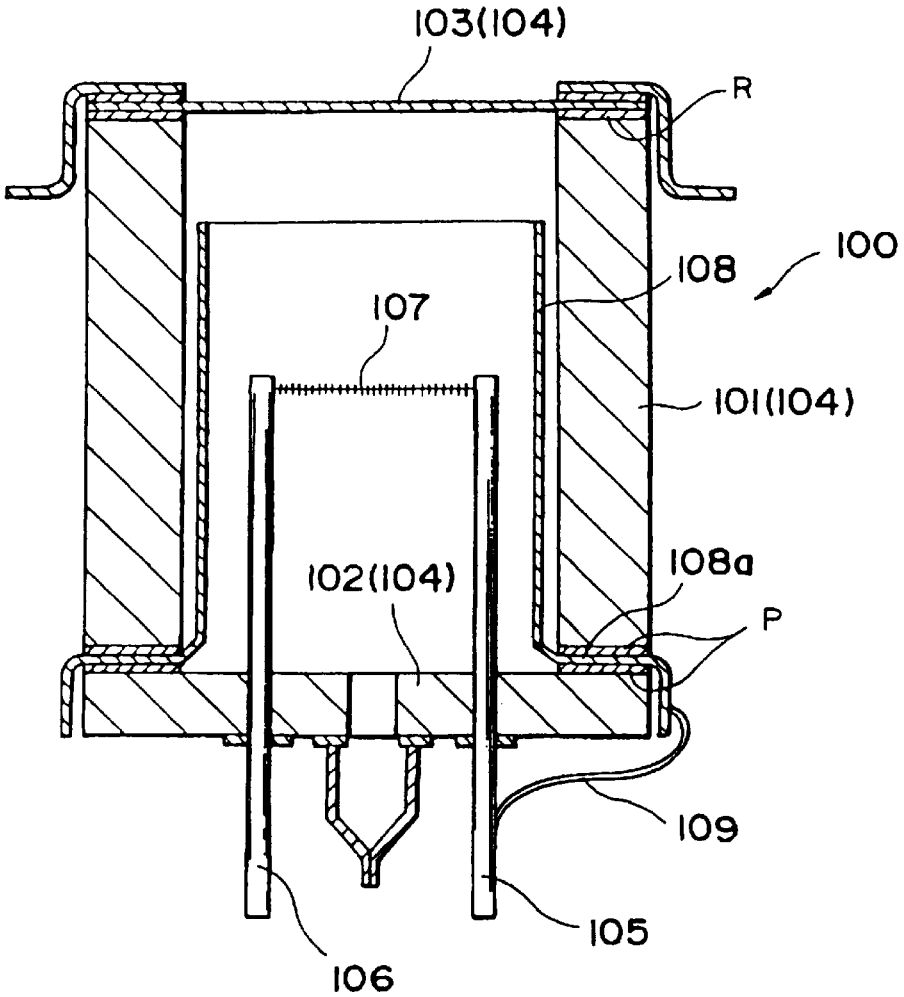
FIG. 10 (PRIOR ART)
FIG. 10 is a cross-sectional view showing a conventional x-ray tube.

A third embodiment relating to the stem of the present invention will be described based on FIGS. 7 to 9. A metallized layer 31 is provided on the stem 30. The metallized layer 31 extends linearly from the position of the flange portion 8*a* (FIG. 1) of the focussing electrode 8 until the pin insertion hole 32*a* which is for inserting the low voltage cathode pin 5*a*. In concrete terms, one end of the metallized layer 31 is positioned so as to contact the flange portion 8*a* on the interior front surface side of the stem 30. The other end of the metallized layer 31 is positioned so as to contact the pin insertion hole 32*a* on the external surface 30*b* of the stem. This is only an example and various modifications can be made. For example, although not shown in the drawings, the metallized layer 31 can be formed on only the inner front surface 30*a* of the stem 30 to extend linearly from the position of the flange portion 8*a* to the pin insertion hole 32*a*. It should be noted that the numeral 32*b* designates the pin insertion hole for inserting the high voltage cathode pin 5*b*, and the numeral 33 designates an exhaust port connected to an exhaust tube 34.

Incidentally, it goes without saying that the above-described metallized layers 11, 21, 31 can be formed by any method such as printing, coating, or deposition of electrically conductive material on the surface of the stems 3, 20, 30.

Industrial Applicability

The x-ray tube according to the present invention can be used inside air cleaning devices, and used broadly for industry and medical purposes, such as removing charges and neutralizing static electricity from IC, films, powders, and the like by the irradiation of weak x-rays, and removing charges from plastic molded products removed from a metal mold or die.

What is claimed is:

1. An x-ray tube including a sealed vessel comprising a bulb having one open end and another open end, a stem fixed to the one open end of the bulb, and an output window fixed to the another open end of the bulb;

a low voltage cathode pin and high voltage cathode pin extending through the stem, a filament for emitting electrons spanning between the low voltage cathode and the high voltage cathode in the sealed vessel;

a focussing electrode disposed in the sealed vessel and surrounding the filament for converging electrons emitted from the filament and directing the electrons toward the output window so as to discharge an x-ray outwardly out of the output window; characterized by the focussing electrode having a lower end portion sandwiched between the bulb and the stem, and the stem having a surface formed with a metallized layer made from an electrically conductive material, the metallized layer extending at least from the lower end portion of the focussing electrode to the low voltage cathode pin, a brazing material being interposed between the metallized layer and the lower end portion of the focussing electrode for electrically connecting the focussing electrode to the low voltage cathode pin.

2. The x-ray tube as claimed in claim 1, wherein the electrically conductive metallized layer is formed on an entire front surface of the stem except an area surrounding the high voltage cathode pin, the front surface of the stem being in confrontation with the output window.

3. The x-ray tube as claimed in claim 2, wherein a separation groove surrounding the high voltage cathode pin is formed, the electrically conductive metallized layer being removed at a position of the separation groove.

4. The x-ray tube as claimed in claim 1, wherein the electrically conductive metallized layer is formed on the stem surface in confrontation with the output window, the metallized layer comprising a first metallized layer having a ring shape matching a contour of the lower end portion of the focussing electrode, and a second metallized layer having a linear shape and radially inwardly extending from an inner periphery of the first metallized layer to the low voltage cathode pin.

5. The x-ray tube as claimed in claim 1, wherein the electrically conductive metallized layer has a U-shaped configuration having a front surface portion on a front stem surface which is in confrontation with the output window, and a rear surface portion continuous with the front surface portion and at a position on a rear stem surface opposite to the front stem surface, the front surface portion of the metallized layer being formed at a position in contact with at least a part of the lower end portion of the focussing electrode, and the rear surface portion of the metallized layer being formed to reach the low voltage cathode pin.

* * * * *

UNITED STATES PATENT AND TRADEMARK OFFICE

CERTIFICATE OF CORRECTION

PATENT NO. : 6,351,520 B1
DATED : February 26, 2002
INVENTOR(S) : Tutomu Inazuru It is certified that error appears in the above-identified patent and that said Letters Patent is hereby corrected as shown below:

Title page,
Replace Items [75] and [86], to read as follows:
-- [75] Inventor: Tutomu Inazuru --;
-- [86] PCT NO.: PCT/JP98/05486 --.

Signed and Sealed this

Second Day of July, 2002

*Attest:*

*Attesting Officer*

JAMES E. ROGAN
*Director of the United States Patent and Trademark Office*